US006383338B1

(12) United States Patent
Meschenmoser

(10) Patent No.: US 6,383,338 B1
(45) Date of Patent: May 7, 2002

(54) SHOE PRESS ROLL

(75) Inventor: Andreas Meschenmoser, Horgenzell (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/704,567

(22) Filed: Nov. 3, 2000

(30) Foreign Application Priority Data

Nov. 5, 1999 (DE) ..... 199 53 474

(51) Int. Cl.[7] ..... D21F 1/66; D21F 3/00
(52) U.S. Cl. ..... 162/264; 162/358.3; 100/153
(58) Field of Search ..... 162/388.1, 388.2, 162/388.3, 388.4, 388.5, 388.6, 388.7, 388.8, 205, 361, 264, 190, 363, 368; 100/153

(56) References Cited

U.S. PATENT DOCUMENTS

| | | | | | |
|---|---|---|---|---|---|
| 4,570,314 | A | * | 2/1986 | Holik et al. | 29/113 |
| 4,576,682 | A | * | 3/1986 | Laapotti | 162/358 |
| 4,988,410 | A | * | 1/1991 | Meinecke et al. | 162/360.1 |
| 5,167,768 | A | * | 12/1992 | Cronin et al. | 162/205 |
| 5,908,536 | A | * | 6/1999 | Kaasalainen et al. | 162/205 |
| 5,972,170 | A | * | 10/1999 | Hund et al. | 162/358.1 |
| 6,030,502 | A | * | 2/2000 | Meschenmoser | 162/358.3 |
| 6,042,694 | A | * | 3/2000 | Brox | 162/358.3 |

FOREIGN PATENT DOCUMENTS

| | | |
|---|---|---|
| DE | 8805966.9 | 10/1989 |
| DE | 19833423 | 1/2000 |
| WO | 99/45195 | 9/1999 |

* cited by examiner

*Primary Examiner*—Peter Chin
*Assistant Examiner*—Carlos Lopez
(74) *Attorney, Agent, or Firm*—Greenblum & Bernstein P.L.C.

(57) ABSTRACT

A shoe press roll for dewatering a fibrous web in machines for at least one of producing and processing a fibrous web is provided, including a flexible roll jacket having a profiled surface for water absorption. At least one press element is provided, having a concave pressing surface, arranged against a cylindrical mating roll to form a concavely bent press nip for pressing said flexible roll jacket. A continuous dewatering belt is positioned at least between said shoe press roll and the fibrous web for absorbing pressed-out water, being guided off of said roll jacket after the press nip. A water collection device is arranged for collecting and removing water spinoff from said roll jacket said water collection device being positioned between said shoe press roll and said dewatering belt, and as close as possible behind the press nip, relative to a belt travel direction. A transitional zone is arranged to follow said concavely bent press nip comprising a convexly bent beginning zone, relative to the belt travel direction, with a comparatively large bending radius and with a convexly bent end zone with a comparatively small bending radius.

21 Claims, 1 Drawing Sheet

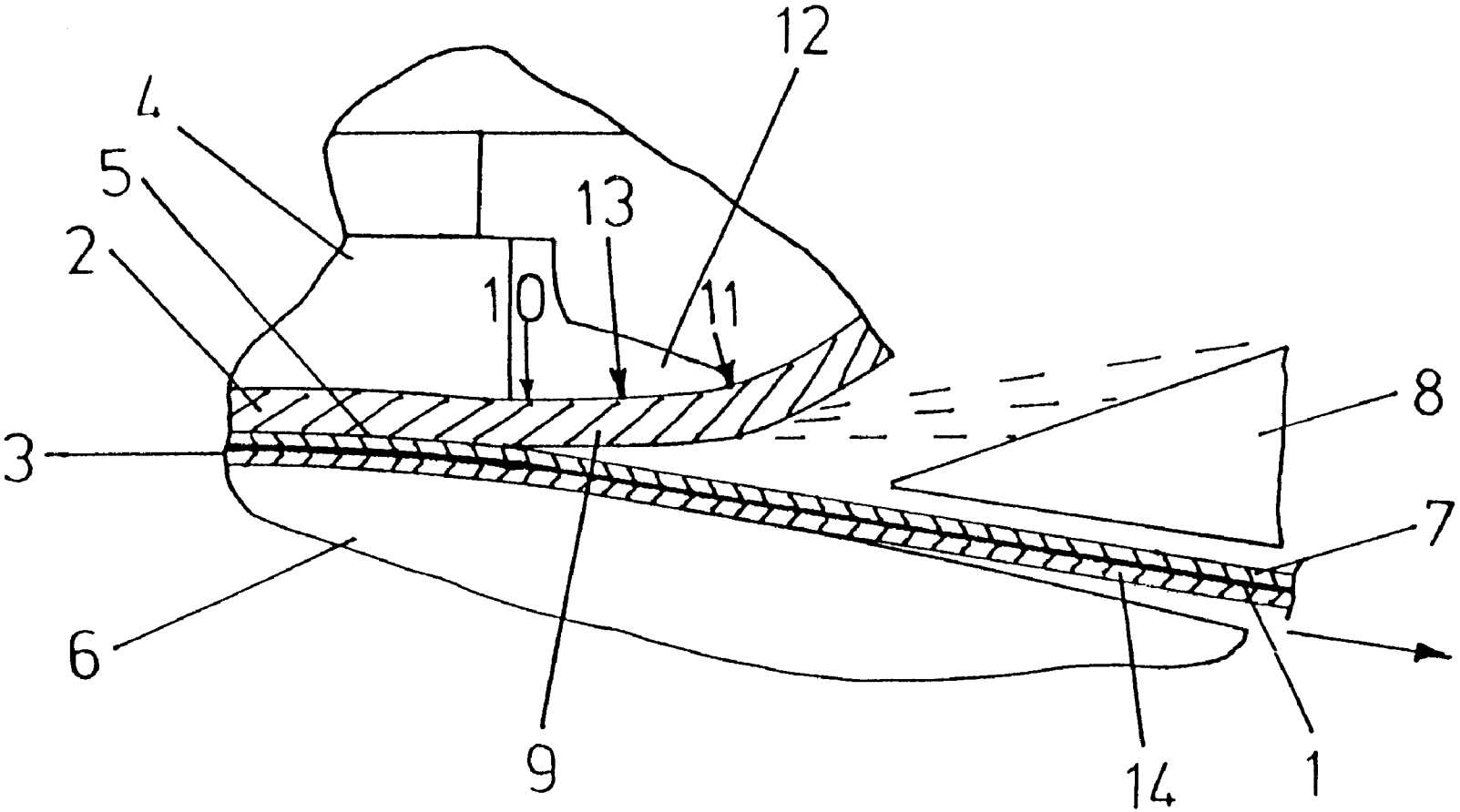
Fig.

SHOE PRESS ROLL

CROSS-REFERENCE TO RELATED APPLICATIONS

The present application claims priority under 35 U.S.C. §119 of German Patent Application No. 19953474.8, filed on Nov. 5, 1999, the disclosure of which is expressly incorporated by reference herein in its entirety.

BACKGROUND OF THE INVENTION

1. Field of the Invention

The invention relates to a shoe press roll for dewatering a fibrous web, in particular a paper web, cardboard web or tissue web, in machines for producing and/or processing the same, comprising a flexible roll jacket with a profiled surface for water absorption which, in order to form a pressing nip, is pressed by at least one pressing element having a concave pressing surface against a cylindrical mating roll with a continuous dewatering belt for absorbing the pressed-out water running at least between the shoe press roll and the fibrous web and which is guided off the shoe press roll behind the press nip and in which a water collection device is provided between the shoe press roll and this dewatering belt as close to the press nip as possible for collecting and removing the water spinning off the roll jacket of the shoe press roll.

2. Discussion of Background Information

Such rolls have been known for a long time in which the water pressed-out of the fibrous web is not only absorbed by the dewatering belt but also by the roll jacket. The water adhering to the surface of the profiled roll jacket is spun off and collected behind the press nip. In order to reduce or avoid the remoistening of the dewatering belt, a water collection device is positioned as close as possible to the end of the press nip. Since this is limited for reasons of construction, however, considerable remoistening of the dewatering belt occurs frequently, in particular at high speeds, and thus also particularly leads to an uneven remoistening of the fibrous web. The moisture cross profile worsened hereby has a very negative effect on the entire production process or processing process.

SUMMARY OF THE INVENTION

It is therefore an aspect of the invention to counteract the remoistening of the dewatering belt by the spinoff water of the roll jacket.

This aspect was attained according to the invention by connecting a transitional zone to the concavely bent press nip that begins with a convexly bent beginning zone with a relatively large radius and ends in a convexly bent end zone with a relatively small radius. The direction and the amount of the water spinoff of the roll jacket is essentially determined by centrifugal forces. However, the centrifugal force is proportional to the square of the speed and inversely proportional to the bending radius. By designing the transitional zone according to the invention, the centrifugal forces are minimized at the beginning and are enhanced only in the end zone due to the relatively small bending radius. Therefore, the spinning off of the water from the surface of the roll jacket essentially occurs at the end of the transitional zone. As an exceptional case, in particular in shoe press rolls with small roll diameters, the beginning zone can also have an infinitely large radius, i.e., run straight.

Due to the high speed of the machine, the direction of the water spun off in the end zone is essentially between the press jacket and the tangent at the beginning of the end zone. As a result, not only is the beginning of the spin-off of considerable amounts of water pushed away from the end of the press nip, but the direction of the spun-off water is also directed more closely towards the roll jacket and away from the dewatering belt. This again allows the collection of considerable parts of the spun-off water by the water collection device which is embodied in a water channel and, in particular, can also be suctioned by a vacuum connection.

The guidance of the roll jacket occurs behind the press nip via a guidance element, where the pressing element and the guidance element should be lubricated. In order to simplify the construction, it is advantageous to connect the guidance element with the pressing element, preferably embodying them as one piece.

In order to shift the beginning of the spin-off of the water as far away from the press nip as possible in the transitional zone between beginning zone and end zone, at least one convexly bent transitional zone and/or at least one straight transitional zone should be provided. Here, the bending radius of a bent transitional zone that may be present should be considerably larger than that of the end zone. In case of the infinitely large bending radius, the so-called straight transitional zone would be the result.

It can also be advantageous for the bending radius of a convexly bent transitional zone for the lengthening of the transitional zone to be larger, in particular much larger, than that of the beginning zone.

In order to collect and keep as much water as possible, the surface of the roll jacket should be provided with grooves and/or blind bores. These grooves or blind bores relax at the end of the press nip and thus produce an additional suction effect. This suction effect keeps the water at the roll jacket in the bent zone of the beginning zone, therefore, it should be relatively short, preferably considerably shorter than the transitional zone or its sum.

Between the mating roll and the fibrous web, an additional belt, preferably in the form of a dewatering belt, or a transfer belt can be provided for guiding the fibrous web from the mating roll to a subsequent unit. The dewatering belts are generally formed as wires or felts and serve to absorb and remove the water pressed-out in the press nip.

The invention is particularly advantageous in shoe press rolls positioned above the fibrous web since here the gravitational force supports the spin-off of the water towards the fibrous web.

According to an aspect of the present invention, a shoe press roll for dewatering a fibrous web in machines for at least one of producing and processing a fibrous web is provided, including a flexible roll jacket having a profiled surface for water absorption. At least one press element is provided, having a concave pressing surface, arranged against a cylindrical mating roll to form a concavely bent press nip for pressing the flexible roll jacket. A continuous dewatering belt is positioned at least between the shoe press roll and the fibrous web for absorbing pressed-out water, being guided off of the roll jacket after the press nip. A water collection device is arranged for collecting and removing water spinoff from the roll jacket said water collection device being positioned between the shoe press roll and the dewatering belt, and as close as possible behind the press nip, relative to a belt travel direction. A transitional zone is arranged to follow the concavely bent press nip comprising a convexly bent beginning zone, relative to the belt travel direction, with a comparatively large bending radius and with a convexly bent end zone with a comparatively small bending radius.

According to another aspect of the present invention, the roll jacket runs over at least one guidance element in the transitional zone. In another aspect of the present invention, the guidance element is connected to the pressing element. According to a further aspect of the present invention, the guidance element is a one piece design. According to a still further aspect of the present invention, wherein, in the transitional zone between the beginning zone and the end zone, at least one convexly bent transitional zone is provided.

Further aspects of the invention include the bending radius of the at least one convexly bent transitional zone being larger than the bending radius of the end zone. According to other aspects of the present invention the transitional zone between the beginning zone and the end zone is provided with at least one substantially straight transitional zone.

According to another aspect of the present invention, the bending radius of the at least one convexly bent transitional zone is larger than the bending radius of the beginning zone. According to a further aspect of the present invention, a surface of the roll jacket is provided with at least one of grooves and blind bores. According to still a further aspect of the invention, the beginning zone is short. Further aspects of the invention include a beginning zone that is shorter than the transitional zone.

According to an aspect of the invention, the water collection device includes a water channel. According to another aspect of the present invention, the collection device is provided with suction. Additionally, other aspects of the present invention include at least one additional dewatering belt including a dewatering belt or a transitional belt that runs between the fibrous web and the mating roll. In another aspect of the present invention, the dewatering belts can be either felts or wires. According to still a further aspect of the invention the fibrous web is one of a paper web, cardboard web and tissue web.

According to a further aspect of the present invention, the convexly bent beginning zone has a radius greater than about 5 mm. According to another aspect of the present invention, the convexly bent end zone has a radius greater than about 5 mm. In another aspect of the present invention, the transitional zone has a radius greater than about 100 mm. According to still a further aspect of the invention, the web travels at a speed greater than about 300 m/min.

According to an aspect of the invention, a shoe press roll for dewatering a fibrous web is provided including at least one press element, with a flexible roll jacket having a profiled surface for water absorption, the at least one press element forming a concave pressing surface and a transitional zone located next to the concave pressing surface in web travel direction, the transitional zone comprising a convexly bent beginning zone and a convexly bent end zone; a cylindrical mating roll arranged to form a concavely bent press nip with the concave pressing surface of the at least one press element; a continuous dewatering belt positioned at least between the shoe press roll and the fibrous web for absorbing pressed-out water guided off the flexible roll jacket; and a water collection device positioned between the at least one press element and the dewatering belt.

Other exemplary embodiments and advantages of the present invention may be ascertained by reviewing the present disclosure and the accompanying drawing.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

In the following the invention, is explained in detail using an exemplary embodiment. The attached drawing shows the figure of a schematic cross-section of the press nip 3 according to the invention.

For dewatering the fibrous web 1 is guided here along with one continuous dewatering belt 7, 14 on each side through the press nip 3, for example at a speed greater than about 300 m/min. The dewatering belts 7, 14 made of felt, absorb the expressed water and remove it from the press nip 3.

The press nip 3 is formed by a shoe press roll positioned above the fibrous web 1 and a mating roll with the shoe press roll comprising of a flexible roll jacket 2 with a grooved or blind-bored surface for absorbing water, which is pressed against the mating roll 6 by a press element 4 with a concave pressing surface 5. Here, the pressure of the press element 4 is created hydraulically.

Between the shoe press roll and the upper dewatering belt 7, adjacent to the outlet of the press nip 3, a water collection device 8 is positioned as close to the press nip 3 as possible. This water collection device 8 in the form of a water channel serves for the collection of the water spinoff of the roll jacket 2 of the shoe press roll; this result can be further improved by creating a vacuum in the water channel.

So that as little water as possible is thrown or dripped onto the upper dewatering belt 7, which would lead to an uneven remoistening of the fibrous web 1 and to the contamination of the dewatering belt 7, as much water as possible must be collected in the water channel. For this purpose, the point from which the most substantial part of the water is spun-off is pushed from the exiting press nip 3 towards the water collection device 8. This is achieved in a transitional zone 9 adhering to the concave bent press nip 3 which begins with a convexly bent beginning zone 10 with a comparatively large bending radius, for example greater than about 5 mm, and ends with a convexly bent end zone 11 with a comparatively small bending radius, for example greater than about 5 mm. This is explained in the centrifugal force being reverse proportional to the bending radius which means that the stronger spin-off occurs only in the end zone.

In the transitional zone 9, the roll jacket 2 is guided over a guidance element 12 which is connected here to a press element 4. The pressing surface 5 and the contact surface of the guidance element 12 are lubricated in order to reduce the friction with the roll jacket 2.

Here, the transitional zone 9 also has a convexly bent transitional zone 13 between the beginning zone 10 and the end zone 11. The bending radius of the transitional zone 13, for example greater than about 100 mm, is larger here than that of the beginning zone 10 and considerably larger than the one in the end zone 11 and is preferably correlated generally with the diameter of the roll jacket 2. The transitional zone 13 shifts the end zone 11 away from the press nip 3 with no or only a small amount of water being spun off due to the large bending radius.

In order to reduce the danger of spinoffs in the beginning zone, it is designed to be very short, i.e., considerably shorter than the transitional zone 13. Additionally, the relaxing of the grooves and blind bores of the flexible roll jacket 2 behind the press nip 3 briefly creates a vacuum which keeps the water in the beginning zone 10 at the roll jacket 2.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A shoe press roll for dewatering a fibrous web in machines for at least one of producing and processing a fibrous web, comprising:

a flexible roll jacket having a profiled surface for water absorption;

at least one press element, having a concave pressing surface, arranged against a cylindrical mating roll to form a concavely bent press nip for pressing said flexible roll jacket;

a continuous dewatering belt, positioned at least between said roll jacket and the fibrous web for absorbing pressed-out water, being guided off of said roll jacket after the press nip;

a water collection device arranged for collecting and removing water spun off from said roll jacket said water collection device being positioned between said roll jacket and said dewatering belt, and as close as possible behind the press nip, relative to a belt travel direction; and a transitional zone surface arranged to follow said concave pressing surface comprising a convexly bent beginning zone, relative to the belt travel direction, and a convexly bent end zone, wherein a bending radius of said end zone is smaller in relation to a bending radius of said beginning zone.

2. The shoe press roll according to claim 1, wherein said roll jacket runs over at least one guidance element in the transitional zone.

3. The shoe press roll according to claim 2, wherein said guidance element is connected to said pressing element.

4. The shoe press roll according to claim 3, wherein said guidance element is a one piece design.

5. The shoe press roll according to one claim 1, wherein, in the transitional zone between the beginning zone and the end zone, at least one convexly bent transitional zone is provided.

6. The shoe press roll according to claim 5, wherein the bending radius of the at least one convexly bent transitional zone is larger than the bending radius of the end zone.

7. The shoe press roll according to claim 1, wherein the transitional zone between the beginning zone and the end zone is provided with at least one substantially straight transitional zone.

8. The shoe press roll according to claim 5, wherein the bending radius of the at least one convexly bent transitional zone is larger than the bending radius of the beginning zone.

9. The shoe press roll according to claim 1, wherein a surface of said-roll jacket is provided with at least one of grooves and blind bores.

10. The shoe press roll according to claim 1, wherein the beginning zone is short.

11. The shoe press roll according to claim 10, wherein the beginning zone is shorter than the transitional zone.

12. The shoe press roll according to claim 11, wherein said water collection device comprises a water channel.

13. The shoe press roll according to claim 12, wherein said water collection device is provided with suction.

14. The shoe press roll according to claim 1, wherein at least one additional dewatering belt comprising a dewatering belt or a transitional belt runs between the fibrous web and said mating roll.

15. The shoe press roll according to claim 1, wherein said dewatering belts comprise felts or wires.

16. The shoe press roll according to claim 1, wherein the fibrous web is one of a paper web, cardboard web and tissue web.

17. The shoe press roll according to claim 1, wherein said convexly bent beginning zone has a radius greater than about 5 mm.

18. The shoe press roll according to claim 1, wherein said convexly bent end zone has a radius greater than about 5 mm.

19. The shoe press roll according to claim 1, wherein said transitional zone has a radius greater than about 100 mm.

20. The shoe press roll according to claim 1, wherein said continuous dewatering belt is arranged to transport the web at a speed greater than about 300 m/min.

21. A shoe press roll for dewatering a fibrous web, comprising:

at least one press element forming a concave pressing surface;

a flexible roll jacket having a profiled surface for water absorption;

a transitional zone surface located next to said concave pressing surface in a web travel direction, said transitional zone comprising a convexly bent beginning zone and a more convexly bent end zone;

a cylindrical mating roll arranged to form a concavely bent press nip with said concave pressing surface of said at least one press element;

a continuous dewatering belt, positioned at least between said roll jacket and the fibrous web for absorbing pressed-out water, guided off said flexible roll jacket; and a water collection device positioned between said at least one press element and said dewatering belt.

* * * * *